United States Patent [19]

Faber

[11] 3,990,768

[45] Nov. 9, 1976

[54] SPRING STRIP

[75] Inventor: Walter Faber, Munich, Germany

[73] Assignee: Siemens Aktiengesellschaft, Berlin & Munich, Germany

[22] Filed: June 24, 1975

[21] Appl. No.: 589,932

[30] Foreign Application Priority Data

June 28, 1974 Germany ..... 2431220

[52] U.S. Cl. ..... 339/210 R; 339/262 R; 339/217 R

[51] Int. Cl.[2] ..... H01R 13/42; H01R 11/22

[58] Field of Search..... 339/210 R, 210 M, 210 T, 339/206 R, 206 L, 206 P, 207 R, 207 S, 214 R, 214 C, 214 S, 215 R, 215 S, 216 R, 216 T, 262 R, 262 F, 262 P, 262 RR, 217 R, 217 J, 217 PS, 217 S, 217 TP

[56] References Cited

UNITED STATES PATENTS

| | | | |
|---|---|---|---|
| 3,543,220 | 11/1970 | Jones | 339/207 R |
| 3,646,500 | 2/1972 | Wessely | 339/210 R |
| 3,732,529 | 5/1973 | Weisenburger | 339/210 M |

*Primary Examiner*—Joseph H. McGlynn
*Assistant Examiner*—James W. Davie
*Attorney, Agent, or Firm*—Hill, Gross, Simpson, Van Santen, Steadman, Chiara & Simpson

[57] ABSTRACT

An elongated electrical spring strip has an insulating housing comprising a base and a cover snap-locked together. Channels formed in the housing carry multiple parallel contact springs therein transversely to the longitudinal direction of the housing. Shoulders on each contact spring lock the spring into its channel in the housing. A square-sectioned connection pin with a right-angle bent portion is engaged between and may be spot-welded to the contact spring shoulders. The bent portion is captured in a recess between the housing base and the cover to prevent movement relative to the housing when a straight portion of the pin extending from the housing is connected to another electrical component.

4 Claims, 6 Drawing Figures

SPRING STRIP

BACKGROUND OF THE INVENTION

1. Field of the Invention

This invention relates to electrical contact strips useful with plug-in components and solderless connectors.

2. The Prior Art

Spring strips are insulating housings which are equipped with contact springs and which are generally fixed to the transverse component of a plug-in rack, so that when a plug-in unit is connected, contact blades or pins secured to the end of the plug-in unit penetrate between the contact springs and thus establish an electrical connection between the rack wiring and the electrical devices arranged in the plug-in unit. Solderless connections are increasingly being used for connections with such contact springs and strips. One such connection technique is the so-called wire-wrap method. The satisfactory application of such method necessitates connecting pins which are mechanically stable and have square-sections projecting from the spring strip.

Contact springs and connecting pins produced integrally from sheet metal are inexpensive but less than ideal devices since the contact springs comprise a relatively thin-walled material exhibiting a good spring elasticity whereas the connecting pins should consist of a relatively thicker material both square in cross-section and as mechanically stiff as possible.

Where the contact spring and connecting pin in the prior art have been composed of two metal components produced independently of one another, vibration and shaking occurring upon connection of a wire to the pin too frequently results in an impairment of the connection between the contact spring and the connection pin, including in some cases a complete break.

SUMMARY OF THE INVENTION

The principal object of the invention is to provide a spring strip wherein the connection of wires to the connecting pins of the contact springs does not impair the connection between a contact spring and its connection pin.

Thus, in a spring strip each of the connection pins are provided with portions bent at right angles thereto to engage and be clamped between shoulders of the contact springs in the housing and be clamped firmly between the base and the cover of the spring strip housing. A spot weld between the connecting pin and the contact spring assures a low-resistance electrical connection therebetween.

By this structure the connecting pins of the contact springs are safely fixed in the strip housing not by means of the contact springs but substantially independently of the latter so that mechanical forces on the connecting pins are transmitted directly to the housing and absorbed thereby rather than by the contact springs. Thus substantially all stress between the contact spring and the connection pin is avoided.

DESCRIPTION OF THE PREFERRED EMBODIMENTS

Figure 1:
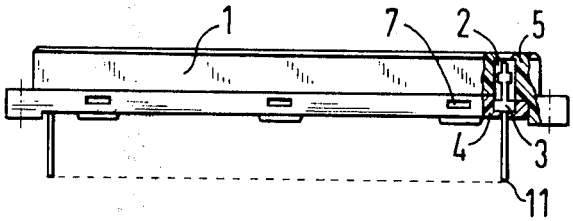
FIG. 1 is a side view, partially in section, of a spring strip.
Figure 2:
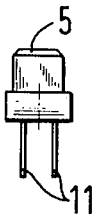
FIG. 2 is an end view of the spring strip.
Figure 3:
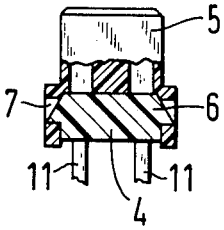
FIG. 3 is a view similar to FIG. 2 but in larger scale and partially in section, through a channel of the strip.

As shown in the figures, a spring strip comprises an elongated housing 1 having a plurality of channels or cavities 2 formed therein transverse to the longitudinal direction of the housing 1. Contact springs 3 are placed within the channels 2 between a base component 4 and a cover 5. The housing 1 is assembled by snap-locks between projections 6 from the base 4 and windows 7 formed in a lower portion of the cover 5.

Figure 4:
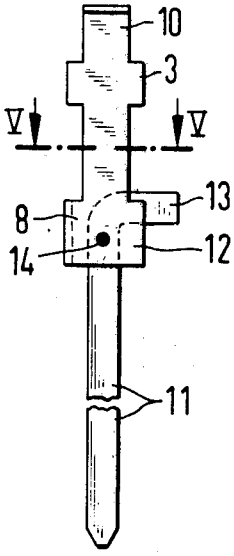
FIG. 4 is an enlarged side view of a contact spring and connection pin attached thereto.
Figure 5:
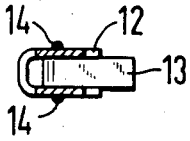
FIG. 5 is a sectional view through the contact spring on line V—V of FIG. 4.

The contact spring 3 has two parallel sides as shown in FIG. 5 with a U-shaped connection at one side of the base portion 12 as shown in FIG. 5 and by the dotted line in FIG. 4. The shoulders 8 are formed in the contact spring 3 at the base thereof and have a size to closely fit into the channel 2. A contact opening is formed in the upper end of a contact spring 3 between parallel contact portions 10 extending from the base component 12 of the contact spring.

Figure 6:
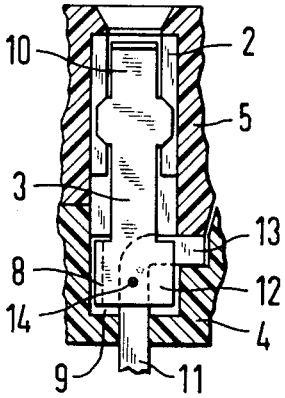
FIG. 6 is a side view and section through the housing and one of the channel-like cavities therein with a contact spring and connection pin inserted therein.

At the lower end of the contact spring 3, opposite the contact opening and contact portions 10, a connection pin 11 consisting of a drawn, square-section wire is inserted between the sides of the base component 12. A squared-off portion 13 is bent at right angles to the connection pin 11 and extends outwardly from the contact spring 3 and the shoulder portion 8 thereof. The connection pin 11 extends through the base of the cavity or channel 2 through the base portion 4 of the housing 1, as shown in FIGS. 1, 2, 3, and 6. The squared-off portion 13 is, as shown in FIG. 6, clamped without play between the base portion 4 and the cover 5 of the housing 1 when the projections 6 on the base 4 snap into the windows 7 of the cover 5.

Although it is possible to obtain a good electrical connection between the contact spring 3 and the connection pin 11 by means of a friction contact alone, it is preferred that the components be spot welded together as at 14 in FIG. 5. Such a spot weld or other firm connection establishes a joint between the connection pin 11 and the contact spring 3 which cannot be impaired by the making and unmaking of solderless connections to the pin 11.

Although various minor modifications might be understood by those versed in the art, it should be understood that I wish to embody within the scope of the patent warranted hereon all such modifications as reasonably and properly come within the scope of my contribution to the art.

I claim as my invention:

1. In a spring strip having an elongated insulating housing defining at least one channel therein, the improvement of a contact spring and connection pin comprising:

a shoulder means on said spring for orienting said spring in said channel and electrically engaging said connection pin;

the connection pin having a straight portion and a right-angle bent portion, the bent portion engaging said shoulder means and extending free thereof to an end, and the straight portion extending exteriorly of said housing coaxially with said channel; and the end of said bent portion of said pin being held in clamped engagement by the housing adjacent the channel, thereby to transfer force loads from said connection pin to said housing rather than to said contact spring.

2. In a spring strip, the improvement of claim 1, wherein said connection pin is connected to said contact spring by at least one welding point.

3. In a spring strip, the improvement of claim 1, wherein said contact spring has a U-shaped base component forming said shoulder means, the connection pin being received between the arms thereof.

4. In a spring strip, the improvement of claim 1, wherein said housing comprises a base portion and a cover portion snap-lockable together and which together define adjacent said channel a recess in which said bent portion of said connection pin is clamped.

* * * * *